United States Patent [19]

Garner et al.

[11] 4,244,758

[45] Jan. 13, 1981

[54] IGNITION ENHANCER COATING COMPOSITIONS FOR AZIDE PROPELLANT

[75] Inventors: Eugene F. Garner; Brian K. Hamilton, both of Canyon County, Calif.

[73] Assignee: Allied Chemical Corporation, Morris County, Morris Township, N.J.

[21] Appl. No.: 905,828

[22] Filed: May 15, 1978

[51] Int. Cl.[2] ..... C06B 45/34; C06B 35/00; C06B 45/10

[52] U.S. Cl. ..... 149/7; 149/19.7; 149/19.91; 149/35; 149/77; 149/82; 149/83; 149/85

[58] Field of Search ..... 149/19.6, 19.7, 19.91, 149/35, 77, 82, 83, 85, 7

[56] References Cited

U.S. PATENT DOCUMENTS

| | | | |
|---|---|---|---|
| 3,723,205 | 3/1973 | Scheffee et al. | 149/35 |
| 3,779,823 | 12/1973 | Price et al. | 149/35 |
| 3,797,854 | 3/1974 | Poole et al. | 149/35 |
| 3,814,694 | 6/1974 | Klager | 149/35 |
| 3,862,866 | 1/1975 | Timmerman et al. | 149/85 |
| 3,883,373 | 5/1975 | Sidebottom | 149/35 |
| 3,920,575 | 11/1975 | Shiki et al. | 149/35 |
| 3,936,330 | 2/1976 | Dergazarian et al. | 149/35 |
| 3,947,300 | 3/1976 | Passauer et al. | 149/35 |
| 3,964,255 | 6/1976 | Catanzarite | 60/205 |
| 3,977,924 | 8/1976 | McCulloch et al. | 149/35 |
| 3,986,908 | 10/1976 | Grebért et al. | 149/83 |
| 4,128,996 | 12/1978 | Garner et al. | 149/82 |

FOREIGN PATENT DOCUMENTS

| | | | |
|---|---|---|---|
| 2063586 | 7/1971 | Fed. Rep. of Germany | 149/44 |

*Primary Examiner*—Edward A. Miller
*Attorney, Agent, or Firm*—Roger H. Criss

[57] ABSTRACT

An ignition enhancer coating composition for alkali metal azide pyrotechnic propellant compositions comprised of about 2 to 15 weight percent of an oxygen-containing polymeric compound; about 20 to 50 weight percent of an alkali metal azide; and about 40 to 80 weight percent of an inorganic oxidizer. This invention also relates to a pyrotechnic propellant coated with said ignition enhancer composition.

8 Claims, No Drawings

IGNITION ENHANCER COATING COMPOSITIONS FOR AZIDE PROPELLANT

BACKGROUND OF THE INVENTION

1. Field of the Invention

This invention relates to an ignition enhancer coating composition for alkali metal azide-containing pyrotechnic propellant compositions, especially those propellants suitable for use in inflating an inflatable device, such as a vehicle safety restraint.

2. Description of the Prior Art

Various pyrotechnic propellants have been prepared for generating a gas upon combustion in order to inflate an air bag or similar safety restraint in a vehicle so as to restrain movement of an occupant in the event of a sudden deceleration of the vehicle, such as caused by a collision. In order to be employed as restraints, several criteria must be met. The pyrotechnic must be capable of producing non-toxic, non-flammable and essentially smokeless gases over a wide variety of temperatures and other environmental conditions. The gases that are generated must be ignited at a sufficiently low temperature so as not to destroy the restraint or injure the occupant. The pyrotechnic device must also be safe to handle and must be capable of generating a substantial amount of gas within a very short period of time, e.g., less than about 100 milliseconds.

The present leading candidates for commercialization in an all-pyrotechnic inflation system are alkali metal azide-based compositions. Such compositions exhibit excellent gas generating properties and produce a gas which consists almost totally of non-toxic nitrogen gas.

SUMMARY OF THE INVENTION

In accordance with the invention, there is provided an ignition enhancer composition suitable for use with alkali metal azide-based pyrotechnic propellants wherein said propellants are suitable for use in automobile safety restraint devices. The ignition enhancer compositions of the present invention are comprised of about 2 to 15 weight percent of an oxygen-containing polymeric compound, preferably a polyvinyl acetate resin; about 20 to 50 weight percent of an alkali metal azide, preferably sodium azide; and about 40 to 80 weight percent of an inorganic oxidizer, preferably sodium or potassium chlorate or perchlorate. Preferably the instant ignition enhancer compositions are used as coatings on pyrotechnic propellants in order to assure a complete and efficient ignition of the propellant.

DESCRIPTION OF THE PREFERRED EMBODIMENT

Pyrotechnic propellant compositions for which the presently claimed ignition enhancers can be used are any of the alkali metal azide-based pyrotechnic propellants generally known in the art. Non-limiting examples of such compositions include those containing an alkali metal azide, and an inorganic perchlorate as described in U.S. Pat. No. 3,936,330. Also included are those compositions containing a major amount of an alkali metal azide such as sodium azide and a minor amount of a metal oxide such as iron oxide. Preferably, the pyrotechnic propellant is in the form of grains or pellets which have a geometry which provides a substantially constant surface area exposed to burning during combustion. By use of the present invention rapid onset of gas generation is assured preferably by coating the present ignition enhancer onto the surface of the pyrotechnic propellant pellets.

It is also within the scope of this invention to use other ingredients conventionally used in pyrotechnic propellants such as carbon black, graphite, metals, metal halides, etc.

Oxygen-containing polymeric compounds suitable for use in the present ignition enhancer compositions are those combustible polymeric materials containing a substantial amount of oxygen. Non-limiting examples of such compounds include polyvinyl acetate resins, polyesters, polyurethanes, polyester-polyurethane copolymers, and polymers based on cellulose compounds such as cellulose acetate, and the like. Preferred is polyvinyl acetate.

Non-limiting examples of inorganic oxidizers suitable for use in the present invention include the alkali metal oxidizers such as sodium chlorate, potassium chlorate, sodium perchlorate, potassium perchlorate, sodium nitrate, potassium nitrate, as well as ammonium perchlorate, ammonium nitrate, and the like. Also, bromates or iodates may be employed instead of the corresponding chlorates (or perchlorates). Preferred are the sodium and potassium chlorates and perchlorates, more preferred are sodium and potassium perchlorate, and most preferred is potassium perchlorate.

Alkali metal azide compounds suitable for use in the present invention are those compounds represented by the formula $MN_3$ wherein M is an alkali metal, preferably sodium or potassium, more preferably sodium.

The ignition enhancer compositions of the present invention are comprised of about 2 to 15 wt. %, preferably about 6 to 10 wt. %, combustible oxygen-containing polymeric compound; about 20 to 50 wt. %, preferably about 25 to 35 wt. %, alkali metal azide and about 40 to 80 wt. %, preferably about 55 to 65 wt. %, inorganic oxidizer.

It is preferred that the ignition enhancer compositions of the present invention be used as a coating for azide-based pyrotechnic propellants. When these ignition enhancer compositions are used as coatings, superior results are obtained.

The method of applying the ignition enhancer composition to the propellant is not critical. One preferred method of coating the propellant is by first preparing a coating mix. This is accomplished by dissolving the oxygen-containing polymeric compound in an appropriate solvent such as methylene chloride in a mixing vessel such as a ball mill jar. The alkali metal azide and inorganic oxidizer are placed in the jar, along with grinding balls. The jar is placed on a ball mill for a time sufficient to form a suspension—generally up to about 12 hours. The propellant to be coated, in pellet form, is placed in an appropriate container such as a stainless steel mesh basket and dipped into the coating mix with agitation for a time sufficient to completely coat the propellant pellets—generally for about 10 seconds. The basket is then withdrawn from the mix and suspended over the solution to drip and slightly dry for about 10 to 20 seconds. The coated pellets are then baked in an oven at about 120° to 200° C., preferably 140° to 160° C. for 0.5 to 2 hours, preferably 0.75 to 1.25 hours.

The propellant is weighed before and after coating to determine the weight and thickness of the coating which of course can be easily calculated by one skilled in the art. To decrease the weight of the coating more solvent can be added and conversely to increase the weight of the coating some solvent is permitted to evaporate. Generally the coating will constitute about 1 to 5 wt. %, preferably about 2.5 to 3.5 wt. %, based on the total weight of the coated pellet.

In order to further describe the present invention, the following non-limiting example is given.

EXAMPLE

A pyrotechnic composition consisting of 80 weight percent sodium azide and 20 weight percent ferric oxide can be prepared by intimately mixed by ball milling under methylene chloride, dried, and pressed into pellets. The pellets are coated with an ignition enhancer composition consisting of 8 weight percent polyvinyl acetate, 32 weight percent sodium azide, and 60 weight percent sodium perchlorate. The coating on the pellets should constitute about 3 weight percent based on the total weight of the coated pellets.

The coated pellets are then placed into a cylindrical steel casing, to which a nozzle is attached. The pellets are ignited and the burn rate is found acceptable for automobile safety restraint devices.

It is to be understood that variations and modifications of the present invention may be made without departing from the scope thereof. It is also understood that the present invention is not to be limited by the specific embodiment disclosed herein but only in accordance with the appended claims when read in light of the foregoing specification.

What is claimed is:

1. An ignition enhancer composition for coating alkali metal azide-based pyrotechnic propellants which comprises:

(a) about 2 to 15 weight percent of a combustible oxygen-containing polymeric compound selected from the group consisting of cellulose acetate resins and polyvinyl acetate resins;

(b) about 20 to 50 weight percent of an alkali metal azide; and (c) about 40 to 80 weight percent of an inorganic oxidizer;

wherein all weight percents are based on the total weight of the ignition enhancer composition.

2. The composition of claim 1 wherein the oxygen-containing polymeric compound is polyvinyl acetate.

3. The composition of claim 1 wherein the inorganic oxidizer is selected from the group consisting of sodium chlorate, potassium chlorate, sodium perchlorate and potassium perchlorate.

4. The composition of claim 2 wherein the inorganic oxidizer is sodium perchlorate.

5. The composition of claim 1 wherein the alkali metal azide is sodium azide or potassium azide.

6. The composition of claim 4 wherein the alkali metal azide is sodium azide.

7. The composition of claim 1 wherein:

(a) the combustible oxygen-containing polymeric compound is polyvinyl acetate in an amount of about 6 to 10 weight percent;

(b) the alkali metal azide is sodium azide in an amount of about 25 to 35 weight percent; and (c) the inorganic oxidizer is sodium perchlorate in an amount of about 55 to 65 weight percent.

8. An azide-based pyrotechnic propellant composition suitable for use in inflating an inflatable device, said composition comprising said propellant coated with an ignition enhancer composition, said ignition enhancer composition comprising:

(a) about 2 to 15 weight percent of a combustible oxygen-containing polymeric compound selected from the group consisting of cellulose acetate and polyvinyl acetate resins;

(b) about 20 to 50 weight percent of an alkali metal azide; and (c) about 40 to 80 weight percent of an inorganic oxidizer;

wherein all weight percents are based on the total weight of the ignition enhancer composition.

* * * * *